US011964686B2

(12) United States Patent
Dworschack et al.

(10) Patent No.: US 11,964,686 B2
(45) Date of Patent: Apr. 23, 2024

(54) SWITCH DEVICES AND METHODS FOR MOVING SWITCH RAILS

(71) Applicant: Precision Rail and Mfg., Inc., Oak Creek, WI (US)

(72) Inventors: David Dworschack, Oak Creek, WI (US); James D. Braatz, Oak Creek, WI (US)

(73) Assignee: Precision Rail and Mfg., Inc., Oak Creek, WI (US)

( * ) Notice: Subject to any disclaimer, the term of this patent is extended or adjusted under 35 U.S.C. 154(b) by 411 days.

(21) Appl. No.: 17/332,709

(22) Filed: May 27, 2021

(65) Prior Publication Data

US 2022/0379934 A1 Dec. 1, 2022

(51) Int. Cl.

| | |
|---|---|
| ***H02P 1/04*** | (2006.01) |
| ***B61L 5/02*** | (2006.01) |
| ***B61L 5/06*** | (2006.01) |
| ***B61L 5/10*** | (2006.01) |

(52) U.S. Cl.

CPC ..... *B61L 5/026* (2013.01); *B61L 5/065* (2013.01); *B61L 5/102* (2013.01)

(58) Field of Classification Search

CPC ..... B61L 5/026; B60L 5/065; B60L 5/102; G05B 9/00

See application file for complete search history.

(56) References Cited

U.S. PATENT DOCUMENTS

| | | | |
|---|---|---|---|
| 694,563 | A | 3/1902 | Manager |
| 5,806,809 | A | 9/1998 | Danner et al. |
| 6,164,601 | A | 12/2000 | Scheer et al. |
| 6,300,734 | B1 | 10/2001 | Franke et al. |
| 6,366,041 | B1 | 4/2002 | Bozio et al. |
| 6,422,519 | B1 | 7/2002 | Braatz |
| 6,484,974 | B1 | 11/2002 | Frank et al. |
| 6,568,641 | B2 | 5/2003 | Hoyer et al. |
| 7,649,350 | B2 | 1/2010 | Heyden et al. |
| 8,348,202 | B2 | 1/2013 | Franke |
| 9,156,479 | B2 | 10/2015 | Beamon et al. |
| 9,889,867 | B2 | 2/2018 | Johnson et al. |
| 2010/0083865 | A1 | 4/2010 | Heyden et al. |
| 2011/0251809 | A1 | 10/2011 | Stollenwerk |
| 2020/0017131 | A1* | 1/2020 | Houghton ..... B61L 27/70 |

* cited by examiner

*Primary Examiner* — Karen Masih
(74) *Attorney, Agent, or Firm* — Andrus Intellectual Property Law, LLP

(57) ABSTRACT

A switch device for moving switch rails. The switch device includes a motor operatively coupled to move the switch rails into and between first and second positions. The motor is configured for electricity to flow therethrough along a first path and a second path. A first path relay has two normally open contacts each within the first path, where activating the first path relay closes the two normally open contacts thereof. A second path relay has two normally open contacts each within the second path, where activating the second path relay closes the two normally open contacts thereof. The motor moves the switch rails towards the first position when the first path relay is activated and the second path relay is deactivated, and the motor moves the switch rails towards the second position when the second path relay is activated and the first path relay is deactivated.

20 Claims, 7 Drawing Sheets

SWITCH DEVICES AND METHODS FOR MOVING SWITCH RAILS

FIELD

The present disclosure generally relates to switch devices and methods for moving switch rails.

BACKGROUND

The following U.S. Patents and Patent Publications provide background information and are incorporated by reference in entirety.

U.S. Pat. No. 6,422,519 discloses an improved cylinder head for a railroad track. The switch operator includes totally self-contained electronics and pneumatics for easy and direct replacement of a cylinder head on a prior art Switch operator. The improved cylinder head has enhanced porting to improve air flow and Speed of operation, a Voltage control module permitting the unit to operate with either 24 volt or 12 volt line power, and recessed portions for covering or enclosing delicate and/or Sensitive components for maximized protection in harsh outdoor installations.

U.S. Pat. No. 7,649,350 discloses a railcar presence detector, which includes magnetic field sensors spaced along the length of a rail track for detecting magnetic field disturbances cause be ferromagnetic objects, such as railcars, passing along the rail track. Each of the magnetic field sensors generates an output signal that is received by a control unit. The control unit compares the output signal from each of the magnetic field sensors to a detection threshold and controls the position of a contact member dependent upon the comparison between the output signal and the detection threshold. Each of the magnetic field sensors includes a test device that is selectively operable to modify the magnetic field near the magnetic field sensor to test the operation of the magnetic field sensor. During operation of the system including the magnetic field sensor, the control unit can automatically activate the test device to assure that each of the magnetic field sensors are operating properly.

U.S. Patent Publication No. US 2010/0083865 discloses a device and system for controlling travel of a railcar along a set of rails is provided. In one example, a railcar stop is coupled to the set of rails and is selectively movable between a first position wherein the rail car is free to travel along the set of rails and a second position wherein the railcar stop engages the treads of the wheels to thereby prevent travel of the railcar in at least one direction along the rails.

U.S. Patent Publication No. 2011/0251809 discloses an inductive loop presence detector for sensing objects, such as rail cars, containing one or more sensing loops. The inductive loop presence detector includes a backup power Supply that is connected to a control unit of the detector to power the control unit during an interruption in the line Voltage. The backup power Supply includes batteries or capacitors that power the control unit when the line voltage is interrupted. The control unit of the inductive loop presence detector operates in a lower power mode when the control unit is Supplied with power from the backup power supply. The control unit operates to auto-tune and Supply power to the sensing loops to operate at the most desirable frequency based upon the inductance of the sensing loops.

U.S. Patent Application No. 694,563 is also hereby incorporated by reference herein.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a switch device for moving switch rails. The switch device includes a motor operatively coupled to move the switch rails into and between first and second positions. The motor is configured for electricity to flow therethrough along a first path and a second path. A first path relay has two normally open contacts each within the first path, where activating the first path relay closes the two normally open contacts thereof. A second path relay has two normally open contacts each within the second path, where activating the second path relay closes the two normally open contacts thereof. The motor moves the switch rails towards the first position when the first path relay is activated and the second path relay is deactivated, and the motor moves the switch rails towards the second position when the second path relay is activated and the first path relay is deactivated.

Another embodiment generally relates to a method for moving a switch rails that includes operatively coupling a motor to the switch rails, where the motor is configured to move the switch rails into and between a first position and a second position, and where the motor is configured for electricity to flow therethrough along a first path and a second path. The method further includes electrically coupling a first path relay within the first path of the motor, where the first path relay has two normally open contacts each wherein the first path, and where activating the first path relay closes the two normally open contacts thereof. The method further includes electrically coupling a second path relay within the second path of the motor, where the second path relay has two normally open contacts each within the second path, and where activating the second path relay closes the two normally open contacts thereof. The motor moves the switch rails towards the first position when the first path relay is activated and the second path relay is deactivated, and the motor moves the switch rails towards the second position when the second path relay is activated and the first path relay is deactivated.

Another embodiment generally relates to a switch device for moving a switch rails. The switch device includes a motor operatively coupled to move the switch rails into and between first and second positions, where the motor has first, second, third, and fourth terminals, where the motor is configured to be coupled to a power source having a positive terminal and a negative terminal, where the second terminal of the motor is coupled to the negative terminal of the power source, and where the motor is configured for electricity to flow therethrough along a first path and a second path. A motor controller is operatively coupled to the motor, where the motor controller is configured to monitor a current drawn by the motor and to compare the current to a predetermined threshold, and where the motor controller is further configured to open at least one of the first path and the second path through the motor when the current exceeds the predetermined threshold. A first relay has a normally open contact within the first path, where the first relay when activated electrically couples the first terminal of the motor to the positive terminal of the power source. A second relay has a normally open contact within the first path, wherein the first relay and the second relay are configured to activate and deactivate together, where the second relay when activated electrically couples the third terminal and the fourth terminal of the motor. A third relay has a normally open contact within the second path, where the third relay when activated electrically couples the third terminal of the motor to the positive terminal of the power source. A fourth relay has a normally open contact within the second path, where the third relay and the fourth relay are configured to activate and deactivate together, and where the fourth relay when activated electrically couples the first terminal and the fourth terminal of the motor. The first relay, the second relay, the third relay, and the fourth relay are configured such that the first relay and the second relay are prevented from being activated when the third relay and the fourth relay are activated. The motor moves the switch rails towards the first position when the first relay and the second relay are activated and the third relay and the fourth relay are deactivated, where the motor moves the switch rails towards the second position when the third relay and the fourth relay are activated and the first relay and the second relay are deactivated.

Various other features, objects and advantages of the disclosure will be made apparent from the following description taken together with the drawings.

BRIEF DESCRIPTION OF THE DRAWINGS

The present disclosure is described with reference to the following drawings.

DETAILED DISCLOSURE

Figure 1:
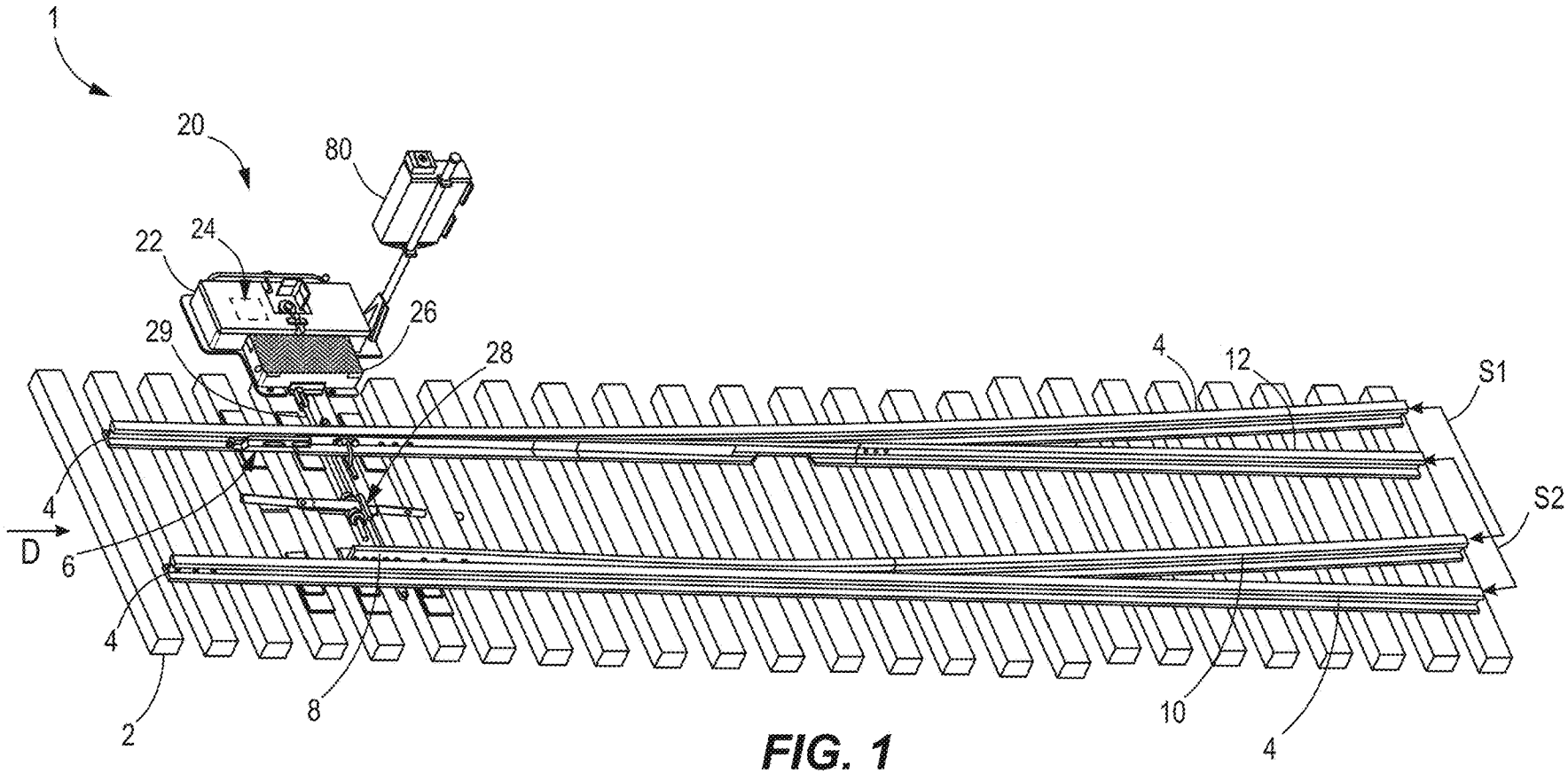
FIG. 1 is a perspective view of a switch device for moving switch rails according to the present disclosure.

The present disclosure generally relates to switch devices and methods for moving switch rails for railroads. A rail road switch (also referred to as a turnout) is a device that enables trains to be guided from one track to another, for example at a railway junction. FIG. 1 shows a rail road switch 1 incorporating a switch device 20 according to the present disclosure for switching between different paths for the rails. The rail road switch 1 includes a first running rail set S1 and second running rail set S2 for a train traveling in the direction D, which are supported on ties 2 in a manner known in the art. The train enters the rail road switch 1 riding along stock rails 4 ahead of the switch device 20. The stock rails 4 continue after the switch device 20, but divide such that each one continues as either part of the first running rail set S1 or the second running rail set S2. The other rail of the first running rail set S1 is formed by a curved closure rail 10, and the other rail of the second running rail set S2 is a straight closure rail 12, as is conventional in the art. A first switch rail 6 and a second switch rail 8 are moveable (by the switch device 20) between first and second positions to select between connecting one of the stock rails 4 to the curved closure rail 10 to direct the train to the first running rail set S1, or to the straight closure rail 12 to direct the train along the second running rail set S2.

The first switch rail 6 and second switch rail 8 are coupled together and move together between the first position and second position. Movement of the first switch rail 6 and second switch rail 8 is performed by the switch device 20, which includes a switch motor 24 contained within an enclosure 22. The switch device 20 and particularly the switch motor 24 therein is operably coupled to a gearbox 26 in a manner presently known in the art. The gearbox 26 converts rotation of the switch motor 24 into linear translation of a switch rod 28, which is connected to a connecting rod 29 coupled to the first switch rail 6 and second switch rail 8 in a manner presently known in the art. In this manner, operation of the switch motor 24 moves the first switch rail 6 and second switch rail 8 between the first and second positions.

FIG. 1 depicts the first switch rail 6 and second switch rail 8 in a second position in which the train would be directed onto the second running rail set S2 (here with only the first switch rail 6 in contact with one of the stock rails 4). In contrast, moving the first switch rail 6 and second switch rail 8 (via the switch device 20) such that only the second switch rail 8 is in contact with one of the stock rails 4 would constitute the first switch rail 6 and second switch rail 8 being in a first position, corresponding to directing the train against the first running rail set S1.

The present inventors have recognized problems with switch devices presently known in the art, including issues with safety while switching. In particular, switch devices known in the arts rely on timers to control how long the motor operators to switch between first and second positions. This method is prone to failure, particularly as the timing to fully transition between first and second positions of the switch rails may vary based on environmental conditions. For example, operation of the motor and/or the resistance in moving the rails may be different in the summer versus when the rail road switch is operated in freezing temperatures. Likewise, any buildup of debris, snow, or ice on the track may resist or slow the transition between the second and first positions. As such, the motor may run too long when the rails move quickly (risking overcurrent and/or damage to components), and too briefly (risking incomplete seating of one of the switch rails on the stock rails).

The present inventors have further recognized a lack of redundancy in providing emergency disconnects for the switch device in the event that failures occur.

Figure 2:
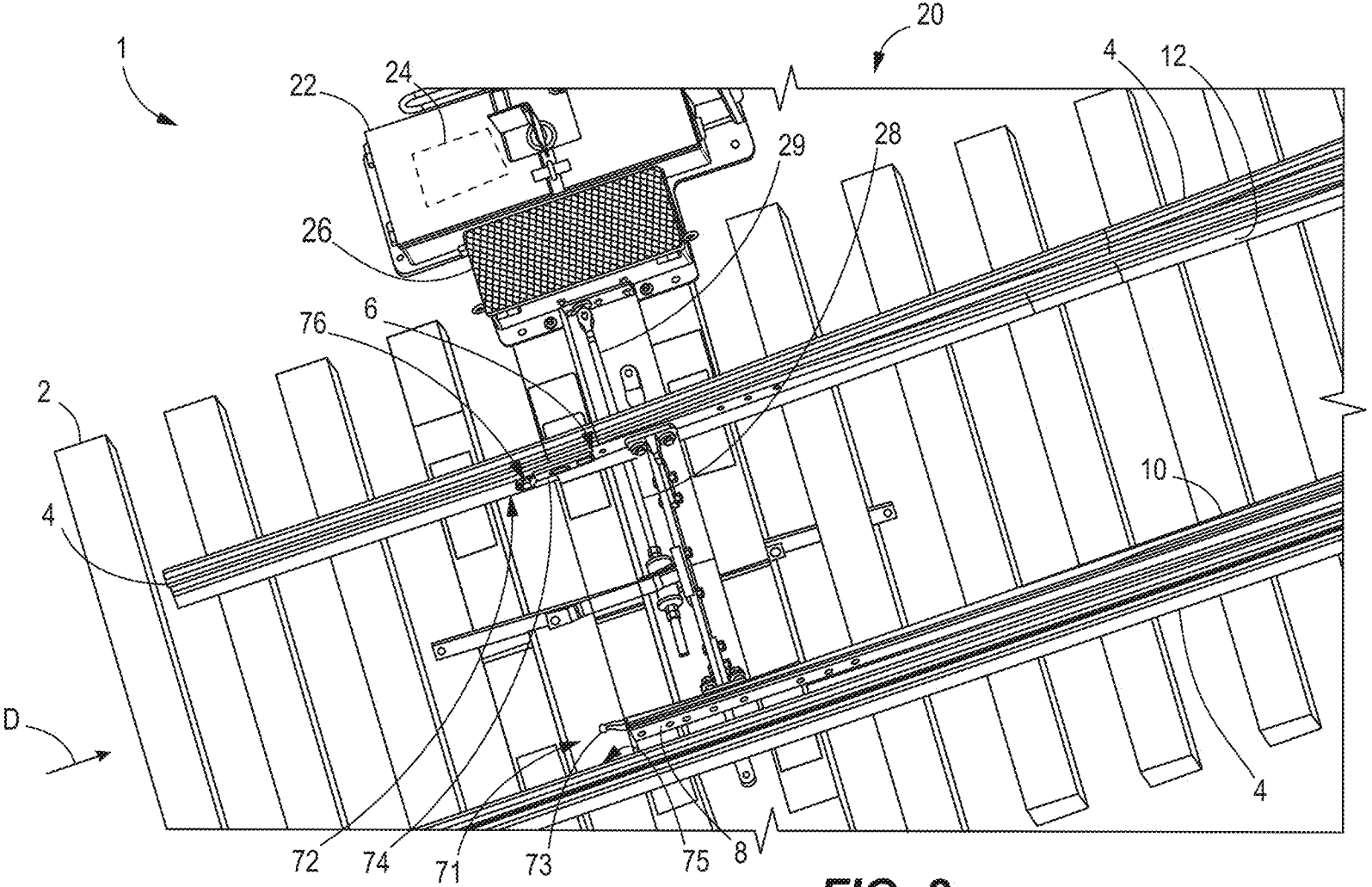
FIG. 2 is close up of the switch device of FIG. 1.

As shown in FIG. 2, the switch device 20 presently disclosed provides an alternate solution for controlling the movement of the switch rails between first and second positions, particularly using a first limit switch 71 and second limit switch 72. First limit switch 71 includes an arm 73 that is coupled to and moves with the first switch rail 6, and the second limit switch includes an arm 74 that is coupled to and moves with the second switch rail 8. The arm 73 of the first limit switch 71 is configured to actuate a switch 75 when the first switch rail 6 is fully seated in the first position against one of the stock rail 4 (here shown as the lower of the stock rails). Likewise, the arm 74 of the second limit switch 72 is configured to actuate a switch 76 when the second switch rail 8 is fully engaged in the second position against the other stock rail 4 (here, the upper stock rail). In this manner, actuation of the first limit switch 71 and the second limit switch 72 allows for determining that the first switch rail 6 and second switch rail 8 are fully seated in the first position and second position, respectively, rather than relying on timing assumptions for moving between the first and second positions. It should be recognized that the first limit switch 71 and/or second limit switch 72 may be of the momentary switch type as shown in FIG. 2 in which physical contact is made between components, or may be of another type, including Hall effect sensors, optical sensors, and/or conductive or resistive sensors, for example.

Figure 3:
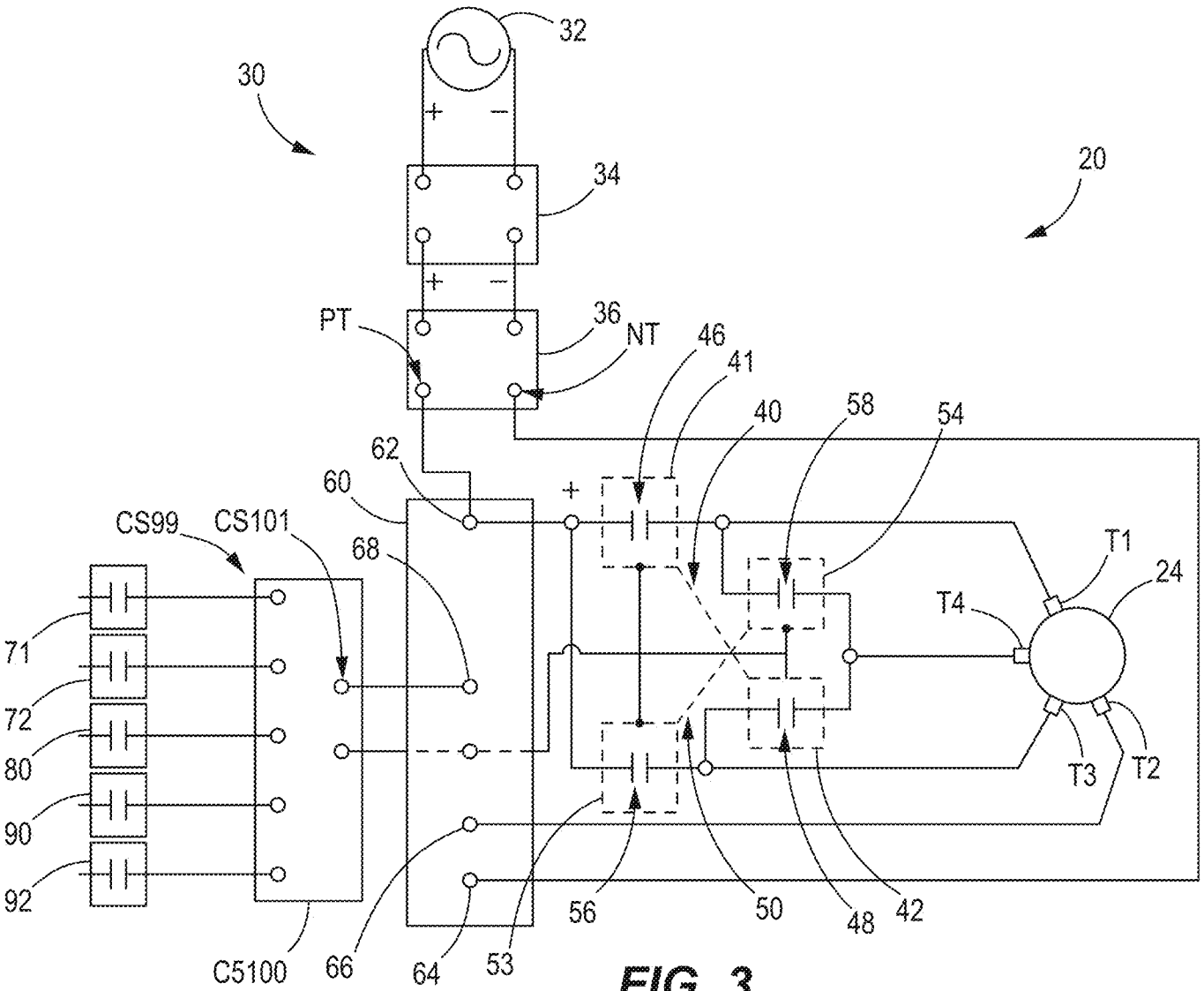
FIG. 3 is an electrical schematic for the switch device of FIG. 1.
Figure 4:
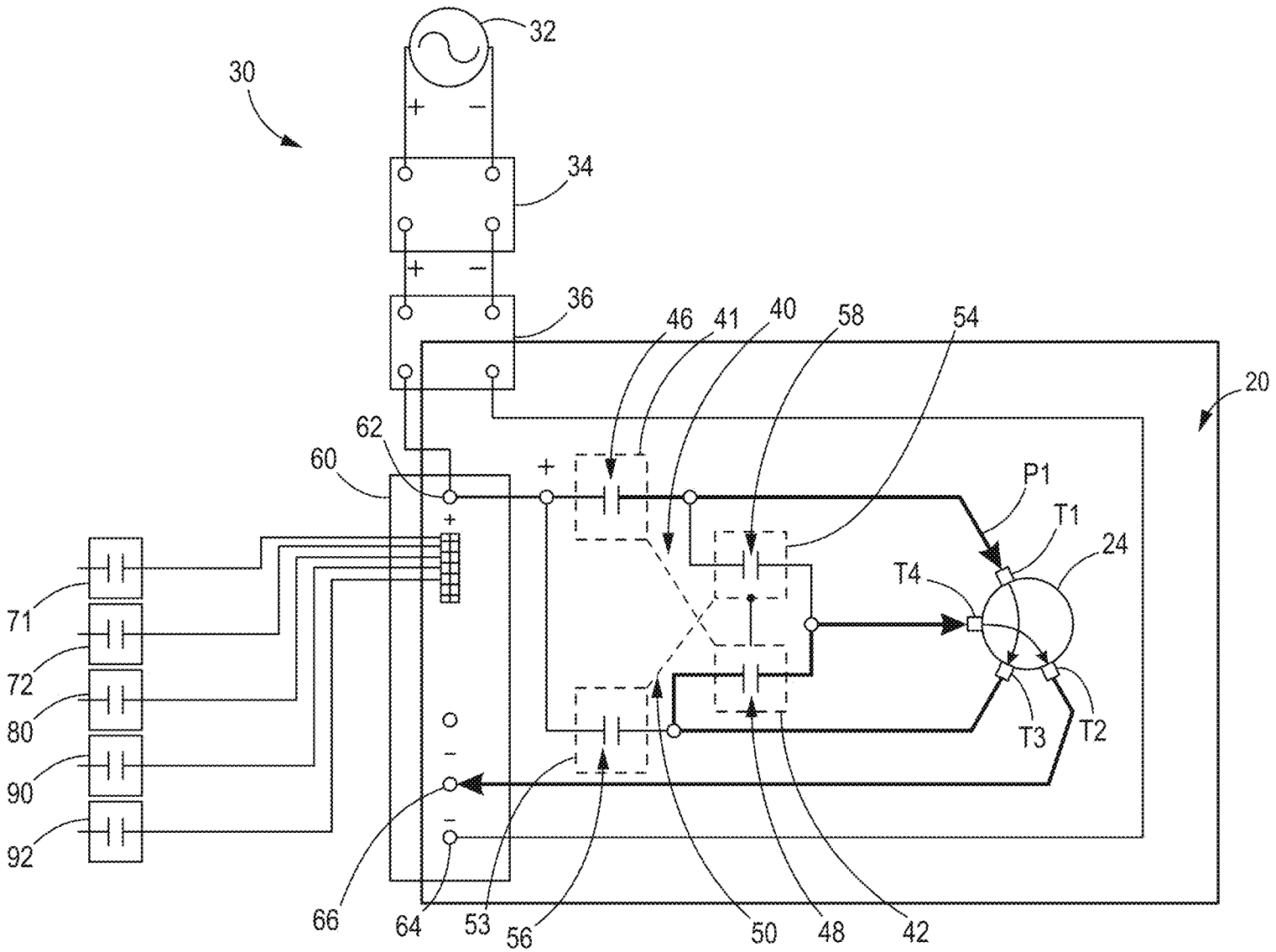
FIGS. 4 and 5 depict electricity flowing through the motor in the electrical schematic of FIG. 3 along first and second paths, respectively.
Figure 5:
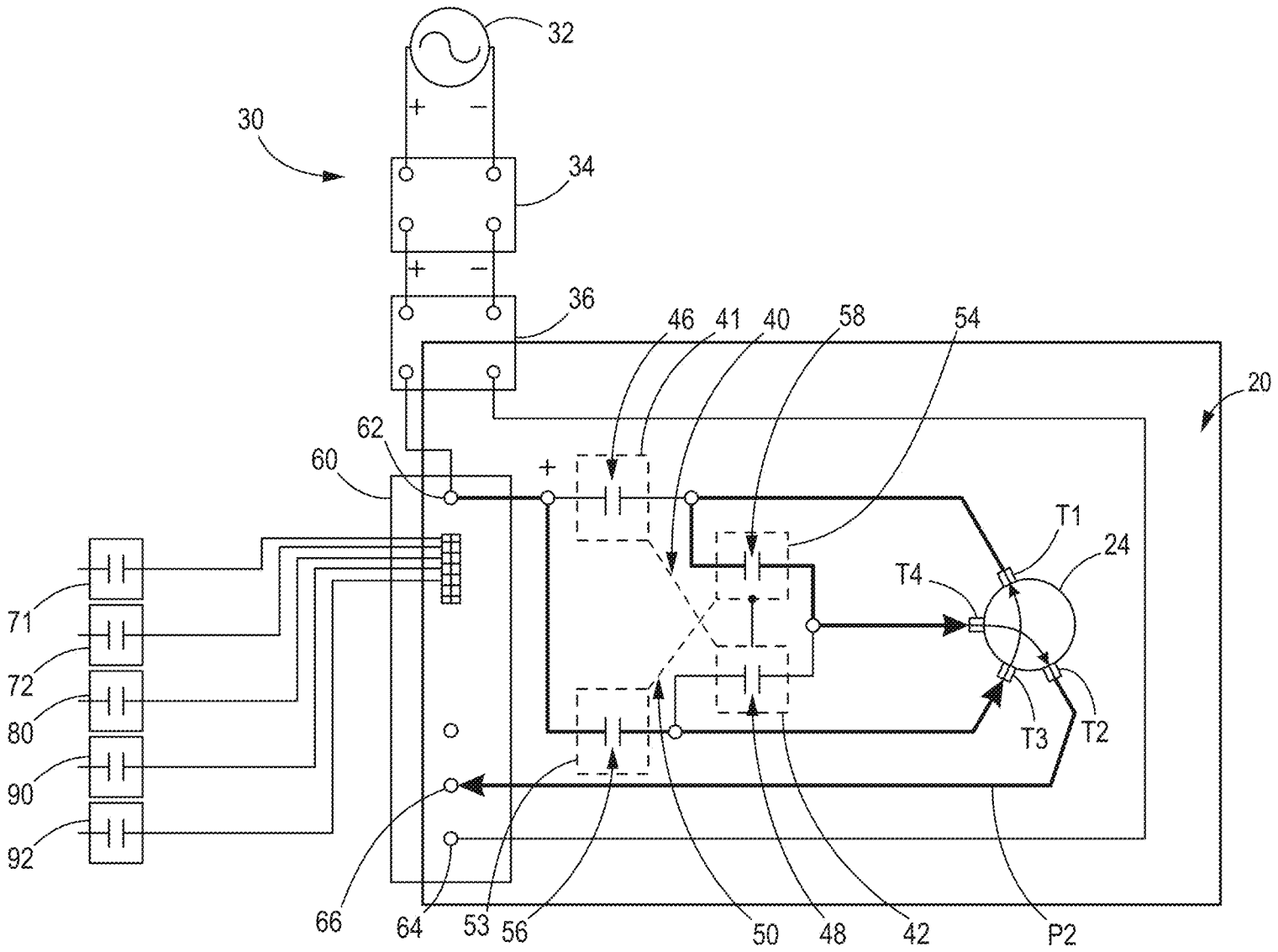

FIG. 3 shows an exemplary electrical schematic for a switch device 20 according to the present disclosure for moving the first switch rail 6 and second switch rail 8 between the first and second positions, and particularly via control of the switch motor 24. The switch motor 24 has a first terminal T1, as second terminal T2, a third terminal T3, and a fourth terminal T4. An exemplary switch motor is the Prestolite MUR-6302 Bi-directional Winch Motor with 4 POST ¾ Shat, 2.5HP, 2500 RPM, 200A; however, other commercially available motors may also be used. The switch motor 24 is configured for electricity to flow therethrough along a first path P1 as shown in FIG. 4, and alternatively a second path P2 as shown in FIG. 5, which are discussed further below. The electricity is provided for the switch motor 24 via a power source 30. The power source 30 includes an AC supply 32, which would be provided via rail yard for operation of the switch device 20. The AC supply 32 is electrically coupled to a battery charging circuit 34, which converts the alternating current from the AC supply 32 to direct current and also maintains a charge of a battery 36 in a manner presently known in the art. An exemplary battery charger is the Minn-Kota Precision Onboard 10A charger, model MK 111PC Part #1831100; however, other commercially available chargers may also be used. This configuration provides for operation on the switch device 20 despite interruptions in the AC supply 32, for example due to power outages and/or of the like. The battery 36 provides a positive terminal PT and negative terminal NT electrically coupled to the switch device 20 to provide electricity thereto. Exemplary batteries include 12VDC AGM battery with Marine and SAE terminals, such as the Northstar NSB-AGM 31M.

With continued reference to FIG. 3, the switch device 20 includes a first path relay 40 having two normally open contacts, here a first contact 46 and second contact 48, which are each provided within the first path P1 as shown in FIG. 4. Activation of the first path relay 40 causes the two normally open contacts to close, thereby completing the first path P1. Similarly, the switch device 20 includes a second path relay 50 also having two normally open contacts, here a first contact 56 and second contact 58, each within the second path P2 as shown in FIG. 5. Activating the second path relay 50 thereby closes the two normally open contacts to complete the second path P2.

In certain examples, the first path relay 40 is comprised of two separate relays each containing one of the two normally open contacts. As shown in FIG. 3, the first path relay 40 is comprised of a first relay 41 having the first contact 46, and a second relay 42 having the second contact 48. In one example, four 48VDC 225A SPST-NO relays with 12VDC coils are used, such as the Trombetta relay part #114-1211-020; however, other commercially available relays may also be used. Similarly, the second path relay 50 is comprised of a third relay 53 having a first contact 56, and a fourth relay 54 having the second contact 58. The first relay 41 and the second relay 42 are configured so as to be activated and deactivated together, simultaneously. Likewise, the third relay 53 and fourth relay 54 are configured to be activated and deactivated together simultaneously. Moreover, the first relay 41 and second relay 42 are configured to prevent being activated when the third relay 53 and fourth relay 54 are activated, and vice versa. In certain examples, this is prevented using PLC logic configured such that upon failure, no motor rotation is permitted (or the motor may only move in one of the two directions, for example). This ensures that electricity flows through the switch motor 24 through only one of the first path P1 and second path P2 at a time.

FIG. 4 depicts electricity flowing through the switch motor 24 along the first path P1. In particular, the first relay 41 and second relay 42 are each activated, with the third relay 53 and fourth relay 54 deactivated. In this manner, the first relay 41 when activated electrically couples the first terminal T1 of the switch motor 24 to the positive terminal PT of the power source 30, and likewise the second relay 42 when activated electrically couples the third terminal T3 of the switch motor 24 and the fourth terminal T4 of the switch motor 24. The second terminal T2 is electrically coupled to negative or ground, which as discussed below may be by virtue of connection to a motor negative terminal 66 of a motor controller 60.

Similarly, FIG. 5 depicts electricity flowing through the switch motor 24 along the second path P2. This occurs when the third relay 53 and fourth relay 54 are activated, with the first relay 41 and second relay 42 deactivated. The third relay 53 when activated electrically couples the third terminal T3 of the switch motor 24 to the positive terminal PT of the power source 30, and likewise the fourth relay 54 when activated electrically couples the first terminal T1 and the fourth terminal T4 of the switch motor 24. The second terminal P2 again remains coupled to the motor negative terminal 66 of the motor controller 60 as in the first path P1 of FIG. 4.

Returning to FIG. 3, the switch device 20 further includes a motor controller 60 operatively connected to the switch motor 24. The motor controller 60 includes a power positive terminal 62, power negative terminal 64, and motor negative terminal 66. The power positive terminal 62 is electrically coupled to the positive terminal PT of the power source 30, and the power negative terminal 64 is electrically coupled to the negative terminal NT of the power source 30. A negative connection (or ground) is provided between the power negative terminal 64 and the motor negative terminal 66 through the motor controller 60.

The motor controller 60 is configured to monitor a current drawn by the switch motor 24 and to compare the current to a predetermined threshold. In one example, the predetermined threshold is set to 300A. The motor controller 60 is further configured to open at least one of the first path P1 and the second path P2 through the switch motor 24 when a current is found to exceed this predetermined threshold. Exemplary motor controllers include Alltrax Inc.'s SR Performance Series and PMDC Motor Controller (e.g., SR72500), or Alltrax's "Axe" line (e.g., model 7245).

In the example of FIG. 3, the motor controller 60 further includes a control signal terminal 68 that is electrically coupled to a control system CS100. The control system CS100 includes terminals for connecting to a series of input devices CS100, as well as output devices 101. Here, the control system CS100 is coupled to the control signal terminal 68 of the motor controller 60 to control operation of the switch motor 24 and/or motor controller 60. The control system CS100 is also electrically coupled to the first relay 41, the second relay 42, the third relay 53 and the fourth relay 54 to control activation and deactivation thereof. The motor controller 60 is also operatively coupled to the first relay 41, the second relay 42, the third relay 53, and the fourth relay 54 to enable opening of the first path P1 and such or second path P2 when the current through the switch motor 24 exceeds the predetermined threshold as discussed above. It should be recognized that the motor controller 60 and control system CS100 may be integrated into a single system, or further subdivided into additional controllers.

The exemplary input devices CS99 coupled to the control system CS100 may include the first limit switch 71 and second limit switch 72 previously discussed. Additional examples including a manual override switch 80 that is a two position switch externally located to be accessible by the user, for example, which may be activated by an operator during maintenance of the rail road switch 1 or to override during failures of various sensors, the first limit switch 71 or second limit switch 72 (with for example may be a lever arm switch with SPDT contacts, such as Automation Direct AEM2G4520Z11MR of other commercially available switches), and such of the like. The manual override switch 80 may be provided under a lockable cover, for example labeled "Maintenance of Way". A fault signal 90 may also be provided as an input device CS99 to the control system CS100, which may include faults from various elements of the rail road switch 1, including the switch motor 24, control system CS100 itself, and/or the motor controller 60.

Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system CS100 communicates with each of the one or more components of the switch device 20 via a communication link CL, which can be any wired or wireless link. The control module CS100 is capable of receiving information and/or controlling one or more operational characteristics of the switch device 20 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the switch device 20. Moreover, the communication link CL lines are meant only to demonstrate that the various control elements are capable of communicating with one another, and do not represent actual wiring connections between the various elements, nor do they represent the only paths of communication between the elements. Additionally, the switch device 20 may incorporate various types of communication devices and systems, and thus the illustrated communication links CL may in fact represent various different types of wireless and/or wired data communication systems.

The control system CS100 may be a computing system that includes a processing system CS110, memory system CS120, and input/output (I/O) system CS130 for communicating with other devices, such as input devices CS99 and output devices CS101, either of which may also or alternatively be stored in a cloud 1002. The processing system CS110 loads and executes an executable program CS122 from the memory system CS120, accesses data CS124 stored within the memory system CS120, and directs the switch device 20 to operate as described in further detail below.

The processing system CS110 may be implemented as a single microprocessor or other circuitry, or be distributed across multiple processing devices or sub-systems that cooperate to execute the executable program CS122 from the memory system CS120. Non-limiting examples of the processing system include general purpose central processing units, application specific processors, and logic devices.

The memory system CS120 may comprise any storage media readable by the processing system CS110 and capable of storing the executable program CS122 and/or data CS124. The memory system CS120 may be implemented as a single storage device, or be distributed across multiple storage devices or sub-systems that cooperate to store computer readable instructions, data structures, program modules, or other data. The memory system CS120 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

Figure 6:
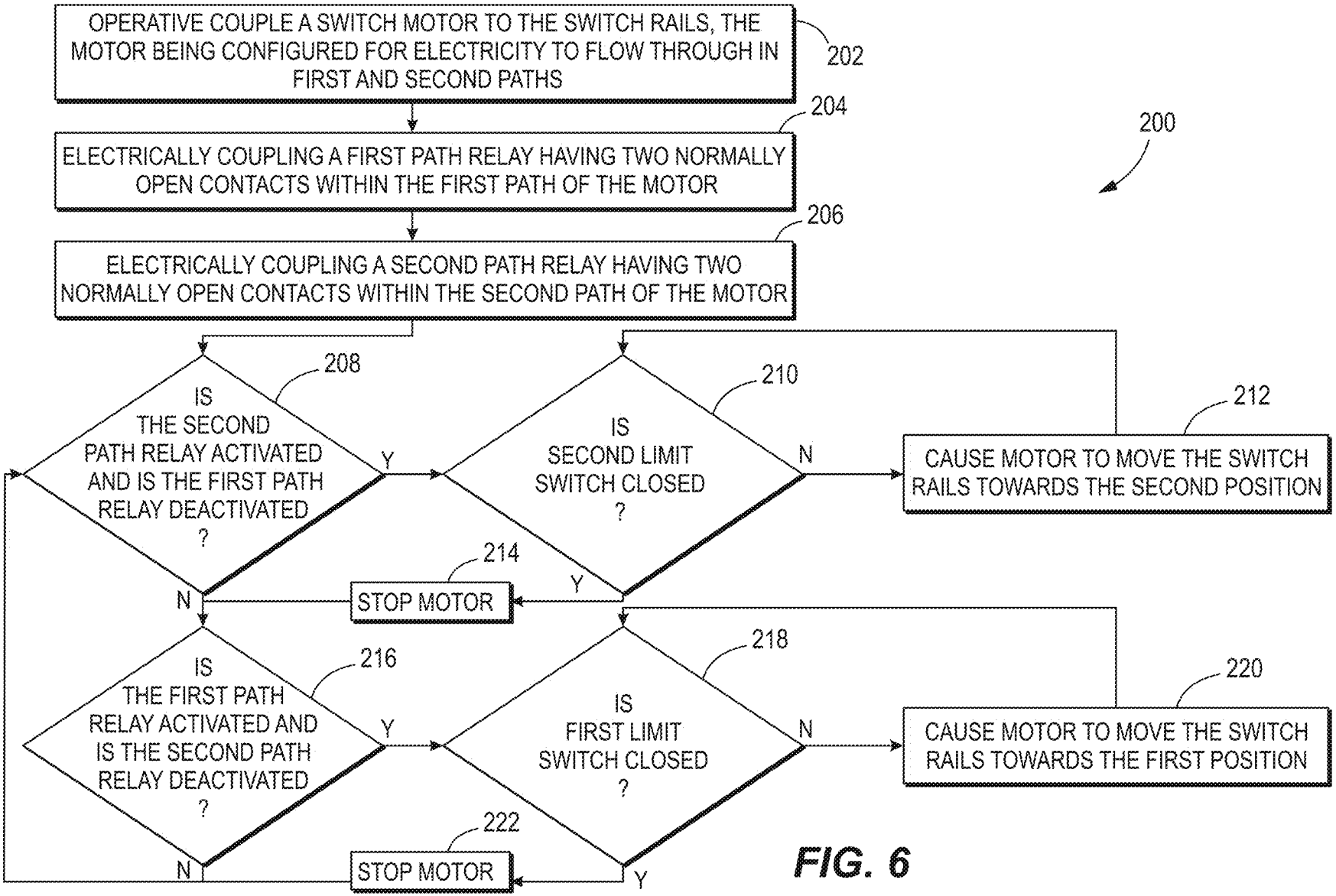
FIG. 6 is a process flow diagram of an exemplary method for moving switch rails according to the present disclosure.
Figure 7:
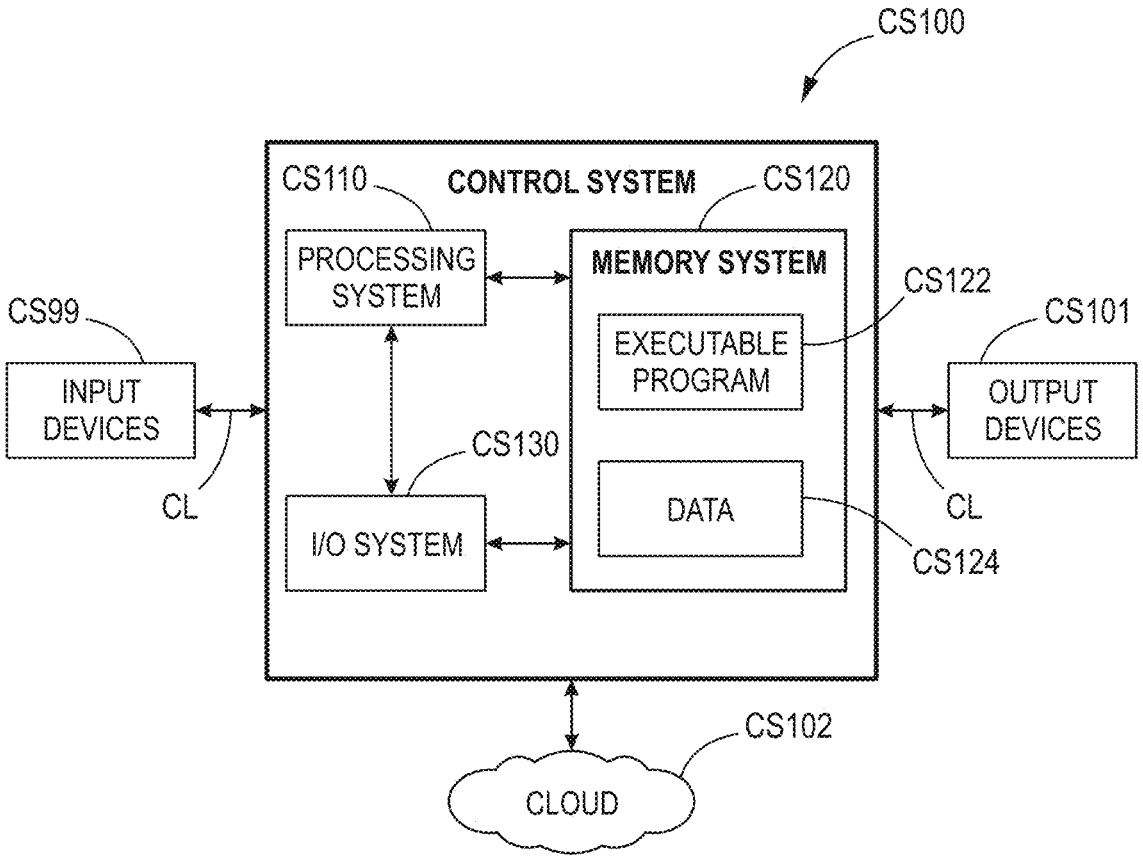
FIG. 7 is an schematic view of a control system such as incorporated in FIG. 3.

FIG. 6 depicts an exemplary process 200 for moving switch rails according o to the present disclosure. Step 202 provides for operatively coupling a motor to the switch rails, where the motor is configured for electricity to flow therethrough along a first path and alternatively along a second path. Step 204 provides for electrically coupling a first path relay having two normally open contacts within the first path of the motor. Step 206 provides for electrically coupling a second path relay having two normally open contacts within the second path of the motor. Step 208 provides for determining whether the second path relay is activated and the first path relay is deactivated, and if so, whether the second limit switch is closed (step 210). If step 208 is affirmative and step 210 is negative, step 212 provides for causing the motor to move the switch rails towards the second position until the second limit switch is closed (step 210), then stopping the motor in step 214.

If instead step 208 is negative, the process 200 continues to step 216, which determines whether the first path relay is activated and the second path relay is deactivated, and if so, whether the first limit switch is closed (step 218). If step 216 is affirmative and step 218 is negative, step 220 provides for causing the motor to move the switch rails towards the first position until the second limit switch is closed (step 218), then stopping the motor in step 222.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A switch device for moving switch rails, the switch device comprising:

a motor operatively coupled to move the switch rails into and between first and second positions, wherein the motor is configured for electricity to flow therethrough along a first path and a second path, wherein the motor has terminals, and wherein one of the terminals is operatively coupled to have the same polarity when the electricity flows via the first path and via the second path;

a first path relay having two normally open contacts each within the first path, wherein activating the first path relay closes the two normally open contacts thereof;

a second path relay having two normally open contacts each within the second path, wherein activating the second path relay closes the two normally open contacts thereof; and wherein the motor moves the switch rails towards the first position when the first path relay is activated and the second path relay is deactivated, and wherein the motor moves the switch rails towards the second position when the second path relay is activated and the first path relay is deactivated.

2. The switch device according to claim 1, wherein the first path relay and the second path relay are prevented from being simultaneously activated.

3. The switch device according to claim 1, wherein the first path relay comprises a first relay and a second relay each having one of the two normally open contacts within the first path.

4. The switch device according to claim 3, wherein the second path relay comprises a third relay and a fourth relay each having one of the two normally open contacts within the second path.

5. The switch device according to claim 4, wherein the first relay and the second relay are activated and deactivated opposingly and simultaneously with each other.

6. The switch device according to claim 4, wherein the motor has first, second, third, and fourth terminals, and wherein the motor is configured to be coupled to a power source having a positive terminal and a negative terminal, wherein the first relay when activated electrically couples the first terminal of the motor to the positive terminal of the power source and the second relay when activated electrically couples the third terminal and the fourth terminal of the motor, and wherein the third relay when activated electrically couples the third terminal of the motor to the positive terminal of the power source and the fourth relay when activated electrically couples the first terminal and the fourth terminal of the motor.

7. The switch device according to claim 6, wherein the second terminal of the motor is coupled to the negative terminal of the power source.

8. The switch device according to claim 1, further comprising a motor controller operatively coupled to the motor, wherein the motor controller is configured to monitor a current drawn by the motor and to compare the current to a predetermined threshold, and wherein the motor controller is further configured to open at least one of the first path and the second path through the motor when the current exceeds the predetermined threshold.

9. The switch device according to claim 1, further comprising a manual override switch that when activated prevents the motor from moving the switch rails.

10. A switch device for moving switch rails, the switch device comprising:

a motor operatively coupled to move the switch rails into and between first and second positions, wherein the motor is configured for electricity to flow therethrough along a first path and a second path;

a first path relay having two normally open contacts each within the first path, wherein activating the first path relay closes the two normally open contacts thereof;

a second path relay having two normally open contacts each within the second path, wherein activating the second path relay closes the two normally open contacts thereof; and a first limit switch activated by movement of the switch rails, wherein the motor stops moving the switch rails when the first limit switch is activated;

wherein the motor moves the switch rails towards the first position when the first path relay is activated and the second path relay is deactivated, and wherein the motor moves the switch rails towards the second position when the second path relay is activated and the first path relay is deactivated.

11. The switch device according to claim 10, wherein the first limit switch is normally open and is closed when the switch rails reaches the first position, further comprising a second limit switch that is normally open and is closed when the switch rails reaches the second position, wherein the motor stops moving the switch rails when the second limit switch is activated.

12. The switch device according to claim 11, further comprising a motor controller operatively coupled to the motor, wherein the motor controller stops the motor from moving the switch rails towards the first position and the second positions when the first limit switch and the second limit switch are activated, respectively.

13. A method for moving a switch rails, the method comprising:

operatively coupling a motor to the switch rails, wherein the motor is configured to move the switch rails into and between a first position and a second position, and wherein the motor is configured for electricity to flow therethrough along a first path and a second path;

electrically coupling a first path relay within the first path of the motor, wherein the first path relay has two normally open contacts each wherein the first path, and wherein activating the first path relay closes the two normally open contacts thereof; and electrically coupling a second path relay within the second path of the motor, wherein the second path relay has two normally open contacts each within the second path, and wherein activating the second path relay closes the two normally open contacts thereof;

wherein the motor moves the switch rails towards the first position when the first path relay is activated and the second path relay is deactivated, and wherein the motor moves the switch rails towards the second position when the second path relay is activated and the first path relay is deactivated.

14. The method according to claim 13, further comprising configuring the first path relay and the second path relay to be prevented from being simultaneously activated.

15. The method according to claim 13, wherein the first path relay comprises a first relay and a second relay each having one of the two normally open contacts within the first path, wherein the second path relay comprises a third relay and a fourth relay each having one of the two normally open contacts within the second path.

16. The method according to claim 15, wherein the motor has first, second, third, and fourth terminals, and wherein the motor is configured to be coupled to a power source having a positive terminal and a negative terminal, further comprising:

electrically coupling the first relay such that the first relay when activated electrically couples the first terminal of the motor to the positive terminal of the power source;

electrically coupling the second relay such that the second relay when activated electrically couples the third terminal and the fourth terminal of the motor;

electrically coupling the third relay such that the third relay when activated electrically couples the third terminal of the motor to the positive terminal of the power source;

electrically coupling the fourth relay such that the fourth relay when activated electrically couples the first terminal and the fourth terminal of the motor; and electrically coupling the second terminal of the motor to the negative terminal of the power source.

17. The method according to claim 13, further comprising operatively coupling a motor controller to the motor and configuring the motor controller to monitor a current drawn by the motor and to compare the current to a predetermined threshold, and further comprising configuring the motor controller to open at least one of the first path and the second path through the motor when the current exceeds the predetermined threshold.

18. The method device according to claim 13, further comprising operatively coupling a first limit switch and a second limit switch to the motor, wherein the first limit switch is normally open and is closed when the switch rails reaches the first position, wherein the second limit switch is normally open and is closed when the switch rails reaches the second position, and wherein the motor stops moving the switch rails towards the first position when the first limit switch is closed and stops moving the switch rails towards the second position when the second limit switch is closed.

19. A switch device for moving a switch rails, the switch device comprising:

a motor operatively coupled to move the switch rails into and between first and second positions, wherein the motor has first, second, third, and fourth terminals, wherein the motor is configured to be coupled to a power source having a positive terminal and a negative terminal, wherein the second terminal of the motor is coupled to the negative terminal of the power source, and wherein the motor is configured for electricity to flow therethrough along a first path and a second path;

a motor controller operatively coupled to the motor, wherein the motor controller is configured to monitor a current drawn by the motor and to compare the current to a predetermined threshold, and wherein the motor controller is further configured to open at least one of the first path and the second path through the motor when the current exceeds the predetermined threshold;

a first relay having a normally open contact within the first path, wherein the first relay when activated electrically couples the first terminal of the motor to the positive terminal of the power source;

a second relay having a normally open contact within the first path, wherein the first relay and the second relay are configured to activate and deactivate together, and wherein the second relay when activated electrically couples the third terminal and the fourth terminal of the motor;

a third relay having a normally open contact within the second path, wherein the third relay when activated electrically couples the third terminal of the motor to the positive terminal of the power source; and a fourth relay having a normally open contact within the second path, wherein the third relay and the fourth relay are configured to activate and deactivate together, and wherein the fourth relay when activated electrically couples the first terminal and the fourth terminal of the motor;

wherein the first relay, the second relay, the third relay, and the fourth relay are configured such that the first relay and the second relay are prevented from being activated when the third relay and the fourth relay are activated; and wherein the motor moves the switch rails towards the first position when the first relay and the second relay are activated and the third relay and the fourth relay are deactivated, and wherein the motor moves the switch rails towards the second position when the third relay and the fourth relay are activated and the first relay and the second relay are deactivated.

20. The switch device according to claim 19, further comprising a first limit switch and a second limit switch each operatively coupled to the motor and activated by movement of the switch rails, wherein the motor stops moving the switch rails towards the first position when the first limit switch is activated and stops moving the switch rails towards the second position when the second limit switch is activated.

* * * * *